US008973561B2

(12) United States Patent
Ruan et al.

(10) Patent No.: US 8,973,561 B2
(45) Date of Patent: Mar. 10, 2015

(54) METHOD FOR ENERGIZING AN HF RESONANT CIRCUIT WHICH HAS AN IGNITER AS A COMPONENT FOR IGNITING A FUEL-AIR MIXTURE IN A COMBUSTION CHAMBER

(75) Inventors: Ganghua Ruan, Ludwigsburg (DE); Gerd Braeuchle, Hueffenhardt (DE); Markus Mueller, Neuenstein (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 746 days.

(21) Appl. No.: 13/215,084

(22) Filed: Aug. 22, 2011

(65) Prior Publication Data

US 2012/0055455 A1 Mar. 8, 2012

(30) Foreign Application Priority Data

Sep. 4, 2010 (DE) ..... 10 2010 042 167
Dec. 22, 2010 (DE) ..... 10 2010 055 715

(51) Int. Cl.
*F02P 3/01* (2006.01)
*F02P 23/04* (2006.01)

(52) U.S. Cl.
CPC ..... *F02P 23/04* (2013.01)
USPC ..... 123/606; 123/608; 123/143 B

(58) Field of Classification Search
CPC ..... F02P 23/04; H01T 13/44
USPC ..... 123/606, 608, 169 R, 623, 143 B
See application file for complete search history.

(56) References Cited

U.S. PATENT DOCUMENTS

| | | | | |
|---|---|---|---|---|
| 4,051,828 | A * | 10/1977 | Topic | 123/606 |
| 8,578,902 | B2 * | 11/2013 | Permuy et al. | 123/143 B |
| 8,869,765 | B2 * | 10/2014 | Braeuchle | 123/143 B |
| 8,869,766 | B2 * | 10/2014 | Burrows | 123/143 B |
| 2002/0121272 | A1 | 9/2002 | Kraus | |
| 2004/0129241 | A1 | 7/2004 | Freen | |
| 2010/0147239 | A1 * | 6/2010 | Lu et al. | 123/169 R |
| 2010/0263643 | A1 * | 10/2010 | Agneray et al. | 123/608 |
| 2011/0203543 | A1 * | 8/2011 | Agneray et al. | 123/143 B |
| 2013/0033906 | A1 * | 2/2013 | Juang et al. | 363/34 |
| 2013/0208393 | A1 * | 8/2013 | Hampton et al. | 361/247 |
| 2014/0020666 | A1 * | 1/2014 | Plotnikov | 123/606 |
| 2014/0182538 | A1 * | 7/2014 | Burrows et al. | 123/143 B |

FOREIGN PATENT DOCUMENTS

| | | | |
|---|---|---|---|
| WO | WO 2010/011838 | A1 | 1/2010 |
| WO | WO 2010/015757 | A1 | 2/2010 |
| WO | WO 2010015757 | A1 * | 2/2010 |

* cited by examiner

*Primary Examiner* — Thomas Moulis
*Assistant Examiner* — Elizabeth Hadley
(74) *Attorney, Agent, or Firm* — Hackler Daghighian & Martino

(57) ABSTRACT

The invention relates to a method for energizing an HF resonant circuit which contains an igniter as a component for igniting a fuel-air mixture in a combustion chamber of an internal combustion engine by means of a corona discharge, wherein the igniter comprises an ignition electrode and an insulator surrounding the ignition electrode, by means of a DC-AC inverter which is excited by successive current pulses which each last while a switch controlled by a control circuit is in its conducting switching state. It is provided according to the invention that the switch is actuated when an instantaneous value of an alternating current or an alternating current voltage excited in the HF resonant circuit falls below a first switching threshold (A−, B−, C−) and the switch s actuated when the instantaneous value of the alternating current or the alternating current voltage excited in the HF resonant circuit exceeds a second switching threshold (A+, B+, C+).

12 Claims, 10 Drawing Sheets

46

METHOD FOR ENERGIZING AN HF RESONANT CIRCUIT WHICH HAS AN IGNITER AS A COMPONENT FOR IGNITING A FUEL-AIR MIXTURE IN A COMBUSTION CHAMBER

Publications WO 2010/011838 A1 and WO 2004/063560 A1 disclose how a fuel-air mixture in a combustion chamber of an internal combustion engine can be ignited by an HF corona discharge generated in the combustion chamber. To this end, an ignition electrode of an igniter is passed through one of the walls of the combustion chamber in an electrically insulating manner, the walls being applied to ground potential, and projects into the combustion chamber, preferably opposite a piston provided in the combustion chamber. Along with the walls of the combustion chamber, which are applied to ground potential, the ignition electrode forms a capacitance as a counter electrode. With its content, the combustion chamber acts like a dielectric medium. Depending on the cycle of the piston, air or a fuel-air mixture or an exhaust gas is present in said combustion chamber.

The capacitance is a component of an electric resonant circuit which is energized by means of a high-frequency voltage which, according to the prior art, is generated by means of a transformer with a center tap. The transformer cooperates with a switching device which alternately applies a specifiable direct current voltage to the two primary windings of the transformer, which are connected by the center tap. The secondary winding of the transformer feeds a series resonant circuit which primarily consists of ohmic resistances and the inductance of the secondary winding as well as the capacitance which is formed by the ignition electrode, the isolator, the outer conductor of the igniter and the walls of the combustion chamber. The frequency of the alternating current voltage that is supplied by the transformer and energizes the resonant circuit is controlled such that it is as close to the resonant frequency of the resonant circuit as possible. This results in a voltage overshoot between the ignition electrode and the walls of the combustion chamber in which the igniter is arranged.

Typically, the resonant frequency is between 30 kilohertz and 3 megahertz, and the alternating voltage reaches values of, e.g., 50 kV to 500 kV at the ignition electrode.

This allows generating a high-frequency corona discharge in the combustion chamber. The corona discharge is not to change into an arc discharge or spark discharge. For this reason, it is made sure that the voltage across the ignition electrode and the ground remains below the voltage for a complete breakthrough.

WO 2010/011838 A1 discloses that the frequency of the resonant circuit is controlled by measuring the phase shift between current and voltage at the feed points of the resonant circuit and is controlled to a value of zero by means of a phase control loop because, in case there is resonance, current and voltage are in phase in a series resonant circuit (phase shift=zero). The phase control loop controls the switching frequency of a switching device which is used to alternately apply a specified voltage to the one primary winding and to the other primary winding of the transformer, with the result that, on the secondary side of the transformer, current and voltage are in phase with each other at the feed points of the series resonant circuit.

The shift of the resonant frequency of the HF resonant circuit which contains the HF igniter is a major problem in the prior art. There are various causes for this. One cause of the shift of the resonant frequency lies in load changes in the combustion chamber of the internal combustion engine, for example, by changes in temperature, in pressure, in moisture, in soiling of the tip or tips of the ignition electrode of the HF igniter and by changes in other parameters which are associated with the operation of the internal combustion engine. The conditions of the corona formation can also shift the resonant frequency. The problem is solved only partially by feeding in the resonant frequency through a phase control loop, such as it is disclosed in WO 2010/011838 A1. With the phase control loop, the deviation of the frequency from the resonant frequency of the HF resonant circuit is readjusted, there will be control deviations, and there may also be overshoots. Smaller control deviations and shorter control times would be desirable. The prior art is to further disadvantage in that the phase control is susceptible to a temperature drift of the components of the phase control loop and to voltage noise. If frequencies are high, there may additionally be great switching losses of the circuit breakers used in the switching device on the primary side of the transformer when the phase shift between current and voltage increases.

SUMMARY OF THE INVENTION

The object of the invention is to create a method of the aforementioned type, in the embodiment of which the disadvantages mentioned above are less grave than in the prior art.

This object is reached by means of a method having the features presented in claim 1. Advantageous refinements are the subject of the subordinate claims.

The method according to the invention deals with the energization of an HF resonant circuit which contains an igniter as a component for igniting a fuel-air mixture in the combustion chamber of an internal combustion engine by means of a high-frequency corona discharge, wherein the igniter comprises an ignition electrode and an insulator surrounding the ignition electrode, with the result that the ignition electrode can be inserted into the combustion chamber such that it is insulated against the walls of the combustion chamber. The insulator can, additionally, be surrounded by a metal outer conductor. According to claim 1, such an HF resonant circuit is energized by means of a DC-AC inverter which, on its direct current side, is activated by a control circuit and energized by means of an electric direct current pulse, said control circuit preferably being operated in a digital manner. The alternating current that occurs in the HF resonant circuit as a response to the current pulse is observed.

To generate and terminate a current pulse, a switch is actuated as soon as an instantaneous value of the alternating current caused in the 1-IF resonant circuit falls below a first switching threshold, and the switch is actuated again as soon as the instantaneous value of the alternating current energized in the HF resonant circuit exceeds a second switching threshold.

In the simplest case, the two switching thresholds may have the same value. For example, a value of zero can be used for both switching thresholds, with the result that the switch is actuated during each zero passage of the alternating current. Preferably, however, the two switching thresholds are different, for example, by the two switching thresholds having different signs. The switching operation of the switch can be carried out during the time period that will then elapse between the point when a switching threshold is reached and a subsequent zero passage, with the result that the start and the end of a current pulse coincide with a zero passage with high precision. Preferably, the switching thresholds are selected such that the switching time deviates from the time that elapses between the point when a switching operation is triggered and a subsequent zero passage of the alternating current by less than a factor of 2, more preferably, corresponds to that time.

With a method according to the invention, the polarity of the current pulse on the direct current side of the DC-AC inverter can be inverted by actuating the switch whenever the zero passage of the current intensity of the alternating current occurs in the HF resonant circuit. The HF resonant circuit is then excited during each half-wave of the alternating current. It is, however, sufficient that the HF resonant circuit is only energized during every second half-wave, i.e., that there is a time lag between two successive current pulses, said time lag corresponding to the time lag between two zero passages. With a variant of the method according to the invention, all current pulses can, therefore, also have the same polarity.

The current pulses for exciting the DC-AC inverter can be generated by means of direct current pulses, preferably square-wave pulses, which are applied to the direct current side of said DC-AC inverter. The instantaneous value of the alternating current or the instantaneous value of the alternating current voltage can be directly observed on the alternating current side of the DC-AC inverter.

The following description of the invention illustrates the advantages and refinements thereof only by means of a monitoring of the alternating current excited in the HF resonant circuit. However, the advantages and refinements also apply to the monitoring of the alternating current voltage in corresponding manner.

The invention has important advantages:

The specified switching thresholds allow the control circuit to directly react to the excited oscillation in the HF resonant circuit. For example, the activation of the DC-AC inverter can be changed, i.e., the polarity of the pulse on the direct current side of the DC-AC converter can be inverted or—if pulses have the same polarity—a pulse can be started or terminated whenever a zero passage of the current intensity of the alternating current occurs in the HF resonant circuit. This means that the control circuit can directly react to the zero passages of the oscillations in the HF resonant circuit.

The method according to the invention allows the control circuit to react more quickly than a conventional phase control loop. The resonant frequency in the HF resonant circuit is reached more quickly and is maintained with smaller deviations than in the prior art.

Whenever the load has been changed, the control circuit reacts by adjusting the resonant frequency in the HF resonant circuit as early as in the next period after the load change.

The invention obviates a phase control loop and the drawbacks thereof.

Control deviations which occur by the readjustment in a phase control loop according to the prior art and which may cause overshoots can be prevented according to the invention.

By avoiding a phase control loop, the method according to the invention can be applied with an electric circuit structure that is simplified as compared with the prior art, with the result that manufacturing costs are saved.

Power switches which are used to provide a specifiable direct current voltage with alternating polarity on the direct current side of the DC-AC inverter have less switching losses than is the case with the method practiced in the prior art, because the polarity of the direct current voltage on the direct current side of the DC-AC inverter is always switched over during the zero passage of the current intensity in the HF resonant circuit.

In contrast to the prior art, the resonant frequency of the HF resonant circuit is exclusively detected by observing the electrical signal and its zero passage in the HF resonant circuit.

The resonant frequency of the HF resonant circuit is controlled on the direct current side (primary side) of the DC-AC inverter exclusively by observing the electrical signal and its zero passages in the HF resonant circuit.

The current through the HF resonant circuit is load-dependent, Load changes of the igniter and changes in the resonant frequency of the HF resonant circuit associated therewith can be detected by observing the changes in the current signal and its zero passage in the HF resonant circuit and compensated by directly controlling the resonant frequency.

Appropriately, the current pulses which are supplied to the DC-AC inverter on its primary side are formed as square-wave pulses or approximately as square-wave pulses. As a result, the HF resonant circuit which is, preferably, configured as a series resonant circuit can be easily excited and adjusted to its resonant frequency.

The method according to the invention can have different embodiments. It utilizes the behavior of an HF resonant circuit, particularly that of an HF series resonant circuit, during the switch-on operation. The transient behavior of the HF resonant circuit is characterized by the roots or zeros points of its transfer function. A transfer function describes the dependency of the output signal of the HF resonant circuit on the input signal thereof, i.e., current pulses or voltage pulses that generate current pulses. An HF resonant circuit which contains an igniter as a component for igniting a fuel-air mixture in the combustion chamber of an internal combustion engine by means of an HF corona discharge usually reacts with a periodic output signal during switch-on, due to the conjugate complex zero points of its transfer function. The zero points of the current or voltage signal which is generated in the HF resonant circuit due to the energization of the latter are the closer to the resonant frequency of the HF resonant circuit the higher the quality of the HF resonant circuit.

The HF resonant circuit can be energized by planning the first pulse with which to feed the DC-AC inverter for a duration which exceeds half the period at an assumed resonant frequency of the HF resonant circuit. The frequency which is assumed as the resonant frequency of the HF resonant circuit can be obtained as an empirical value. Therein, the resonant frequency of the HF resonant circuit that is the smallest possible one under the basic conditions specified can, initially, be estimated while planning the first pulse for energizing the DC-AC inverter and, therefore, the HF resonant circuit for a duration that exceeds half the period at this assumed resonant frequency that is small as possible. The pulse will then excite the HF resonant circuit to oscillate via the DC-AC inverter. According to the invention, the behavior of the alternating current flowing in the HF resonant circuit is observed and the exciting pulse is terminated when the first zero passage of the alternating current occurs. Depending on the variant of the invention, the pulse can be followed by a pause until the next zero passage or the DC-AC inverter can be fed with a pulse of inverted polarity immediately thereafter, said pulse in turn lasting until the next zero passage of the current in the HF resonant circuit, this being followed by another generation of a direct current voltage pulse for feeding the DC-AC inverter, said direct current voltage pulse again having inverted polarity. In either variant, it is ensured that the pulses which are formed to feed the DC-AC inverter and, therefore, to energize the HF resonant circuit are directly generated with a frequency with which the current signal occurs in the HF resonant circuit. This process which is used to energize the HF resonant circuit is continued automatically. An empirical value of the frequency that can be assumed as resonant frequency during subsequent excitation processes of the HF resonant circuit can be derived from observing the frequency of the current signal in the HF resonant circuit. If there is no detection of the zero passage, this empirical value can be assumed as the desired frequency until a zero passage is detected again.

It is, however, also possible to generate the first direct current voltage pulse for a duration that is shorter than half the period at an assumed resonant frequency of the HF resonant circuit whenever an ignition is to take place. In this case, the first zero passage of the current signal in the HF resonant circuit will occur earlier than in the case discussed above, because the shorter selected direct current voltage pulse which is used to feed the DC-AC inverter shortens the transient process of the HF resonant circuit. If, however, the pulse is terminated when the first zero passage occurs in the current signal of the HF resonant circuit in this case as well, the HF resonant circuit is excited with the correct frequency during and after the second zero passage of the current signal, i.e., with the resonant frequency or with a frequency that is close to the resonant frequency of the HF resonant circuit. Here as well, the first pulse can be followed by a pause until the next zero passage or a pulse with inverted polarity can be generated for the DC-AC inverter, wherein said pulse is left present until the next zero passage of the current signal occurs in the HF resonant circuit.

Alternatively, the energizing pulses can be consistently planned for an indefinite duration and their polarity at the input of the DC-AC inverter can be inverted whenever a zero passage of the current intensity occurs in the HF resonant circuit. In this manner, it is also possible to achieve that the HF resonant circuit is always excited with a frequency which is its resonant frequency or is close to its resonant frequency.

Cases are conceivable wherein the zero passage of the current intensity of the current signal in the HF resonant circuit cannot be measured because the measuring equipment that is provided to that end and is used to observe the behavior of the current intensity in the HF resonant circuit has failed or is malfunctioning or because the signal transmitted by the current measuring equipment does not arrive at the control circuit which controls the feed of the DC-AC inverter with direct current voltage pulses. To ensure that an oscillation can be generated in the HF resonant circuit even in such a case, it can be provided that, in any case, a switching operation takes place, i.e., the pulse is terminated after a defined duration which can be stored in the control circuit and which is longer than half the period of the oscillations occurring in the HF resonant circuit. The terminated pulse can be followed by a pulse with inverted polarity or by a pause. The sum of the two pulses with inverted polarity or the sum of the first pulse and the subsequent currentless pause is a period the duration of which is, preferably, a defined specified value and which, preferably, corresponds to the minimum of the resonant frequency that is possible under the given basic conditions of the HF resonant circuit. In this manner, it is possible to ensure that, even if there is a failure of the detection of zero passages of the current signal in the HF resonant circuit, the HF igniter can still ignite, although no longer under optimal conditions.

The zero passages of the current intensity of the current signal in the HF resonant circuit can be detected in various ways. One possibility is to precisely determine the zero passage by means of a detector which detects the change in the sign of the polarity. Another possibility is to define a positive threshold of the current intensity and a negative threshold of the current intensity in the vicinity of the zero passage and to observe the point when the current intensity in the HF resonant circuit crosses the two thresholds of the current intensity. When the zero passage of the current intensity is approached, the pulse fed into the DC-AC inverter is terminated and the next pulse to be fed into the DC-AC inverter is started during the zero passage or when the other threshold is crossed. Particularly in the case first mentioned, there is therefore only a small switching gap between two successive pulses which are fed to the DC-AC inverter with different polarity.

Another possibility is to utilize the defined thresholds of the current intensity in the HF resonant circuit such that every pulse that is fed into the DC-AC inverter either is started when a threshold immediately following a zero passage is crossed and is terminated with the next zero passage or is started with a zero passage and is terminated when the threshold immediately prior to the next zero passage is crossed.

The first switching threshold can be a switch-on threshold and the second threshold can be a switch-off threshold. With a method according to the invention, it is, however, also possible that the first switching threshold is a switch-off threshold and the second switching threshold is a switch-on threshold.

For example, a current pulse applied to the direct current side of the DC-AC inverter can be terminated when an instantaneous value of the alternating current excited in the HF resonant circuit falls below a specified switch-off threshold value and, thereafter, a further current pulse is applied to the direct current side of the DC-AC inverter when an instantaneous value of the alternating current exceeds a specified switch-on threshold value. It is, just as well, possible to terminate a voltage pulse applied to the direct current side of the DC-AC inverter when an instantaneous value of the alternating current excited in the HF resonant circuit exceeds a specified switch-off threshold value and, thereafter, a further voltage pulse is applied to the direct current side of the DC-AC inverter when an instantaneous value of the alternating current falls below a specified switch-on threshold value.

In the method according to the invention, a transformer is preferably used as DC-AC inverter and the pulses are fed into a primary winding of the transformer. If the transformer has only a single primary winding, the pulses can be fed to said primary winding either alternately with varying polarity or—in a different variant of the method—always with the same polarity. The transformer can also have two primary windings which are separated by a center tap and are alternately supplied with the pulses. Therein, the center tap can be applied to unchanging potential, for example, to ground potential. In this case, direct current pulses alternately flow in different directions through the two primary windings, this corresponding to an alternating polarity of the direct current voltage pulses.

The desired high-frequency high voltage does not have to be generated with a transformer. It can also be generated with a DC-AC inverter which is fed on its input side—herein also referred to as primary side—with a direct current voltage from which a high-frequency high voltage that can be directly tapped on the output side—herein also referred to as secondary side—of the DC-AC inverter by means of semiconductor integrated circuits that are known to persons skilled in the art, e.g., by means of an H-bridge circuit, with a high-frequency switch on semiconductor base being arranged in each of the four branches of said H-bridge circuit.

BRIEF DESCRIPTION OF THE DRAWINGS

Below, the invention is illustrated in more detail by means of the enclosed schematic diagrams. Identical or equivalent elements are designated with equal reference symbols in the figures.

DETAILED DESCRIPTION

Figures 1, 1A:
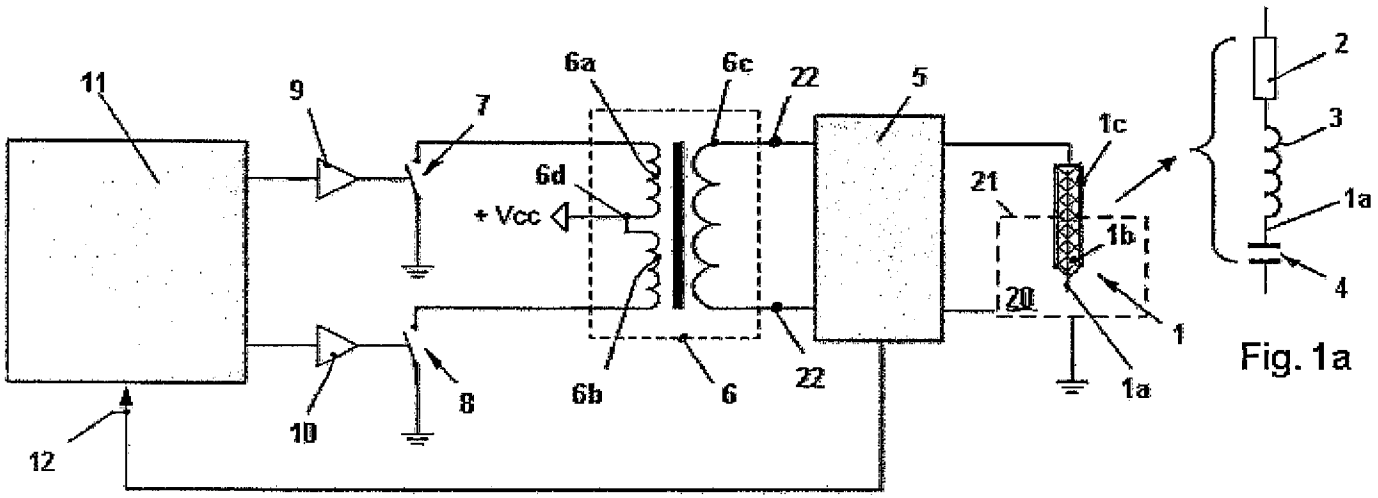
FIG. 1 is a schematic diagram showing the structure of a first HF ignition system for a vehicle engine.
FIG. 1*a* is a detail view of the principal components of an HF igniter which is, at the same time, the essential component of an HF resonant circuit.

FIG. 1 shows a combustion chamber 20 which is limited by walls 21 which are applied to ground potential. An HF igniter 1 which comprises an ignition electrode 1*a* that is surrounded by an insulator 1*b* along a part of its length projects into the combustion chamber 20. The insulator 1*b* is surrounded by a metal outer conductor 1*c* with which the ignition electrode 1*a* is passed through the wall 21 and into the combustion chamber 20 in an electrically insulating manner. If the igniter 1 does not have a separate outer conductor, the combustion chamber wall 12 can also serve as outer conductor into which the igniter 1 is inserted. The igniter 1 and the walls 21 of the combustion chamber 20 are components of a series resonant circuit which, additionally, consists of a capacitance 4, an inductance 3 and an ohmic resistance 2. As a matter of course, the series resonant circuit can comprise further inductances and/or capacitances and miscellaneous components which are known to persons skilled in the art as potential components of series resonant circuits.

A high-frequency generator which has a direct current voltage source and, as DC-AC inverter 6, a transformer with a tap center 6*d* on its primary side is provided for energizing the HF resonant circuit. Two primary windings 6*a* and 6*b* meet at the center tap 6*d*. The ends of the primary windings 6*a* and 6*b* that are remote from the center tap 6*d* are alternately connected to ground by means of a high-frequency switchover device which comprises two circuit breakers 7 and 8. The switching frequency of the high-frequency switchover device determines the frequency which is used to energize the series resonant circuit (FIG. 1*a*) and can be changed by means of a control circuit 11. The secondary winding 6*c* of the transformer 6 feeds the series resonant circuit at an interface 22. The high-frequency switchover device with the circuit breakers 7, 8 is controlled by means of the control circuit 11 such that the HF resonant circuit connected to the interface 22 is energized with its resonant frequency or approximately with its resonant frequency. In this case, the voltage across the tip of the ignition electrode 1*a* and the walls 21 that are applied to ground potential has reached its highest value.

A detector circuit 5 which serves to determine the zero passage of the current intensity of the current signal in the HF resonant circuit is provided between the HF resonant circuit and the secondary winding 6*c* of the transformer 6.

In the exemplary embodiment, the center tap 6*d* of the transformer 6 is connected to a voltage source which supplies the direct current voltage Vcc. The other two connections of the primary windings 6*a* and 6*b* of the transformer 6 are switched against ground via the circuit breakers 7 and 8. It is, however, also possible to connect the center tap 6*d* to ground and to connect the other two connections of the primary windings 6*a* and 6*b* to the voltage source which supplies the direct current voltage Vcc via the circuit breakers 7 and 8.

The control circuit 11 controls when and how long the circuit breakers 7 and 8 are closed. To achieve this, the detector circuit 5 signals each zero passage of the current intensity of the current signal flowing in the HF resonant circuit via a line 12 running to the control circuit 11, with the result that, thereafter, the control circuit 11 alternately generates pulse-shaped control signals for closing the circuit breaker 7 and opening the circuit breaker 8 or for closing the circuit breaker 8 and opening the circuit breaker 7, wherein these control signals can still be amplified by means of amplifiers 9 and 10.

The control circuit 11 can have a varying structure. For example, it can be a microcontroller, but it can also be a field programmable gate array (in short: FPGA), i.e., an integrated circuit in digital technology, in which a logic circuit can be programmed. The control device 11 can also be a complex programmable logic device (CPLD) or an ASIC, i.e., an application-specific integrated circuit, or any other logic circuit.

Figure 2:
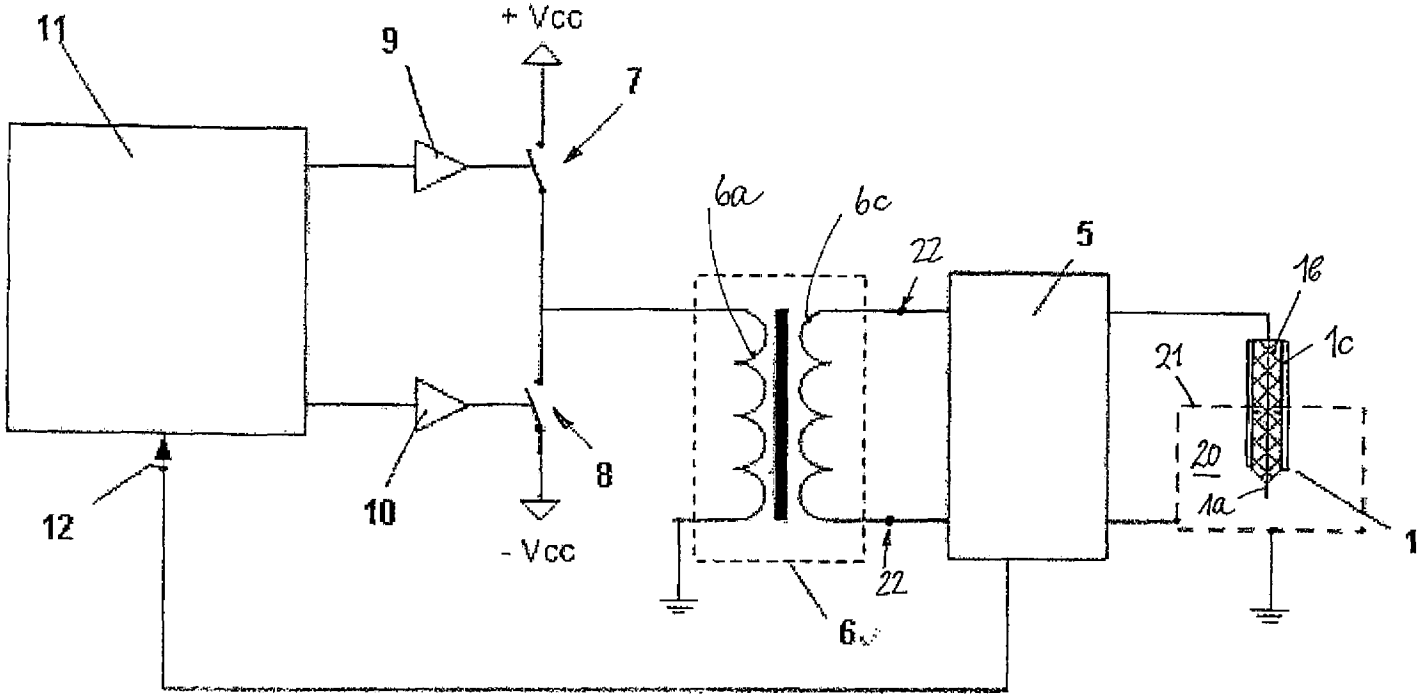
FIG. 2 is a schematic diagram showing the structure of a second HF ignition system for a vehicle engine.

The exemplary embodiment shown in FIG. 2 differs from the exemplary embodiment shown in FIG. 1 in that the transformer 6 has only a single primary winding 6*a* one end of which is applied to ground potential and the other end of which the circuit breakers 7 and 8 alternately connects to a voltage pool that is positive in relation to the ground potential and has potential Vcc and to a voltage pool that has negative potential −Vcc.

In either case, i.e., both in the example shown in FIG. 1 and the example shown in FIG. 2, an alternating field is generated in the transformer 6, wherein said alternating field leads to a high voltage on the secondary side of the transformer and energizes the HF resonant circuit connected to the transformer 6 with a frequency which corresponds to the resonant frequency of the resonant circuit or is close to the resonant frequency.

FIGS. 3 to 6 each show in diagram (a) the start and the end of a possible excitation pulse for closing and opening the circuit breaker 7;

in diagram (b) the start and the end of a possible excitation pulse for closing and opening the circuit breaker 8;

in diagram (c) the behavior of the current intensity of a current signal energized in the HF resonant circuit;

in diagram (d) the start and the end of a control pulse which actually closes and re-opens the circuit breaker 7; and in diagram (e) the start and the end of a control pulse which actually closes and subsequently re-opens the circuit breaker 8.

Figure 3:
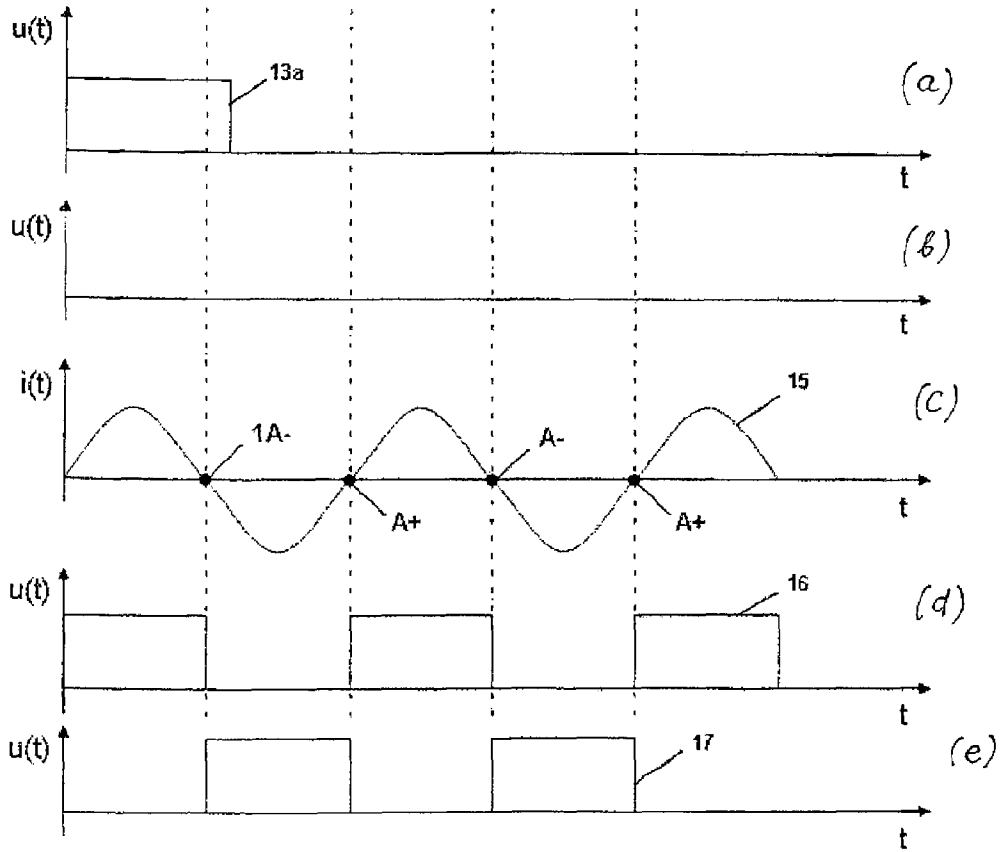
FIG. 3 is a diagram illustrating a first method according to the invention.

FIG. 3 illustrates a method wherein the release of an excitation pulse 13*a* is scheduled for the circuit breaker 7, said excitation pulse 13*a* having a switch-on time that is significantly longer than half the period of the resonant frequency of the HF resonant circuit. The release of such an excitation pulse does not have to be provided for the circuit breaker 8. If the circuit breaker 7 receives the excitation pulse 13*a*, the circuit breaker 7 is closed as early as with the rising edge thereof and the primary side of the transformer 6 is supplied with a direct current voltage, whereby a transient process is started in the HF resonant circuit on the secondary side of the transformer 6. The first zero passage 1A− of the current intensity in the HF resonant circuit at the end of the first half-wave is detected by the detector circuit 5 and signaled to the control circuit 11 via the line 12, wherein said control circuit 11 thereupon opens the circuit breaker 7 and simultaneously closes the circuit breaker 8, with the result that the circuit breaker 7 has actually received a control pulse 16 shown in diagram (d) of FIG. 3 that is shorter than the duration of the excitation pulse 13*a* that was initially planned and is shown in diagram (a) of FIG. 3. Now, the circuit breaker 8 remains closed until the detector circuit 5 detects the next zero passage A+ of the current signal 15, with the result that the circuit breaker 8 is opened and the circuit breaker 7 is closed again at the same time. The interaction of the circuit breakers 7 and 8 is now repeated, as shown in diagrams (d) and (e) of FIG. 3. The control pulses 16 and 17 for the circuit breaker 7 and the circuit breaker 8, respectively, alternately appear with the frequency at which the current signal 15 oscillates in the HF resonant circuit.

After the initial excitation pulse 13*a*, a further excitation pulse is not required. The control pulses 16 and 17 for the circuit breakers 7 and 8 are generated by the occurrence of the further zero passages A+ and A−, so that the activation process for the HF resonant circuit is automatically continued until it is terminated by switching off the voltage supply or the control circuit.

Figure 4:
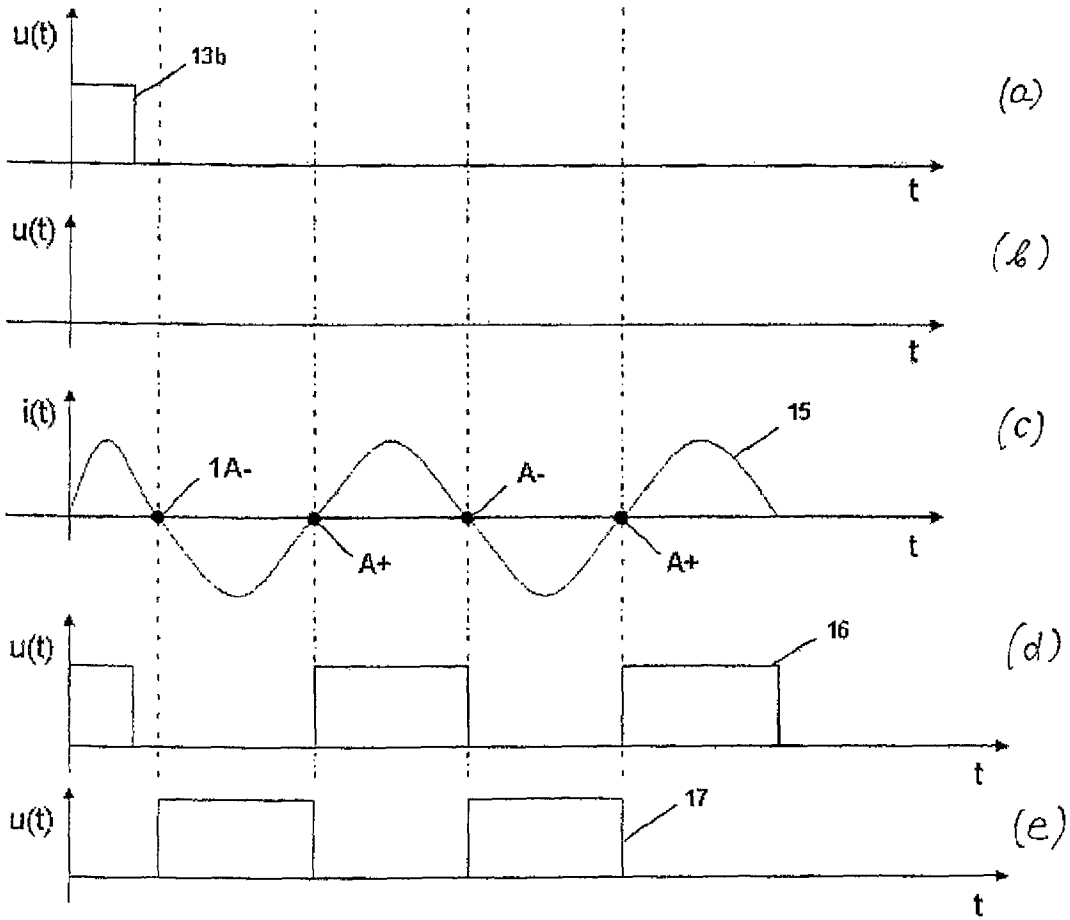
FIG. 4 is a diagram illustrating a second method according to the invention.

The method shown in FIG. 4 differs from the method shown in FIG. 3 in that the initial excitation pulse 13*b* has a switch-on time that is significantly shorter than half the period of the oscillation in the HF resonant circuit at resonant frequency. Due to the shorter switch-on time, the transient process is prematurely aborted, with the result that the half-period of the oscillation of the current signal 15 does not yet correspond to the actual resonant frequency of the HF resonant circuit until the first zero passage 1A−. With the first zero passage 1A−, however, the circuit breaker 8 is closed (as in the first exemplary embodiment) and remains closed until the detector circuit 5 detects the next zero passage A+ of the current signal 15, now without time specification from the control circuit 11, whereby the circuit breaker 8 is opened and the circuit breaker 7 is re-closed. Now, the excitation of the HF resonant circuit continues automatically at the resonant frequency of the HF resonant circuit, as in the exemplary embodiment of FIG. 3.

Figure 5:
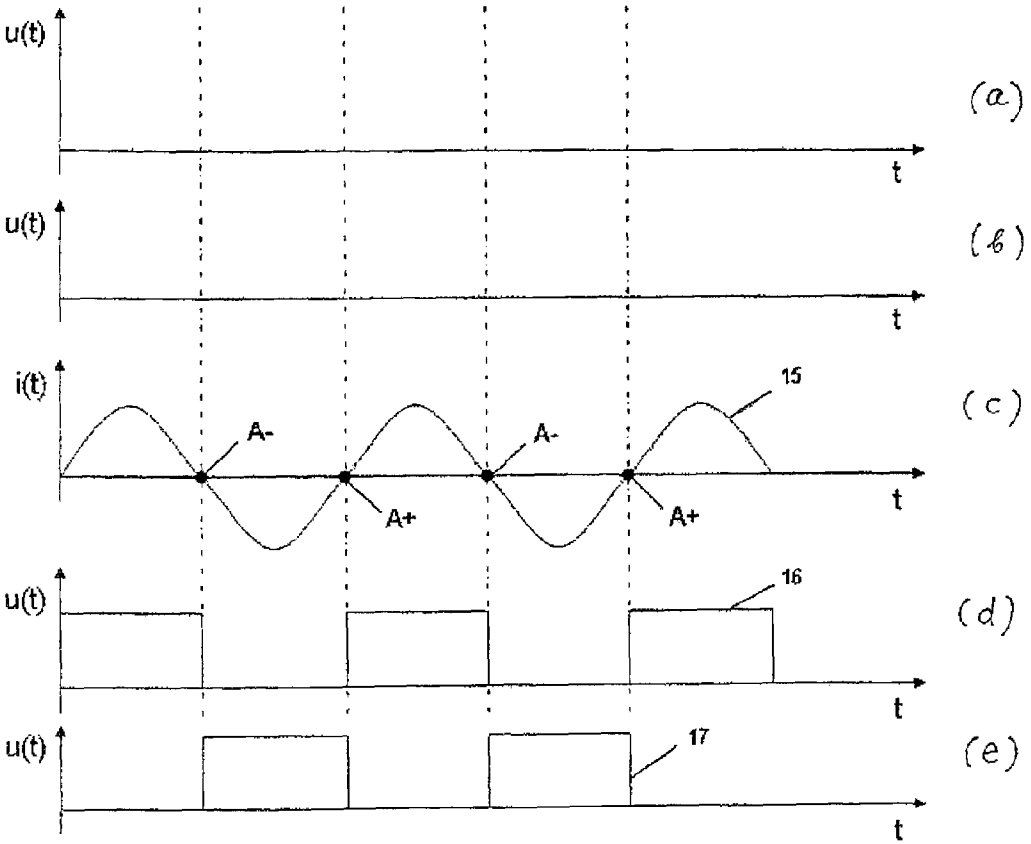
FIG. 5 is a diagram illustrating a third method according to the invention.

The method shown in FIG. 5 differs from the method shown in FIGS. 3 and 4 in that an excitation pulse with a planned duration is not formed in the control circuit 11 in order to start the transient process for the HF resonant circuit. On the contrary, the circuit breaker 7 (or, alternatively, the circuit breaker 8) is closed for a duration that is, initially, indefinite and is re-opened when the detector circuit 5 signals the first zero passage A−, with the result that subsequently, as shown in the examples according to FIG. 3 and FIG. 4, the circuit breaker 7 is opened and the circuit breaker 8 is closed, and the further activation of the HF resonant circuit is automatically controlled by the zero passages of the current intensity in the HF resonant circuit.

Figure 6:
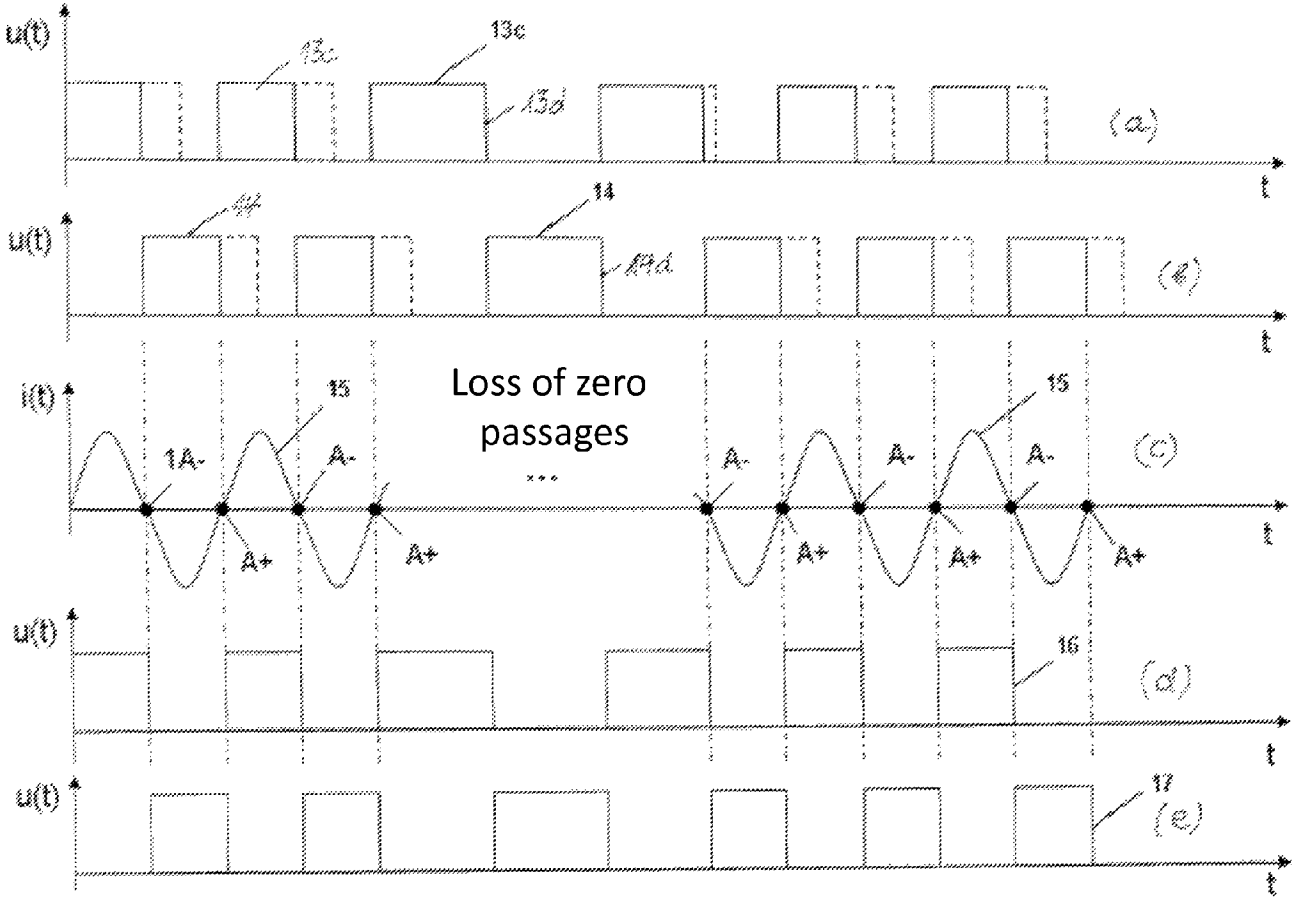
FIG. 6 is a diagram illustrating a fourth method according to the invention.

The method shown in FIG. 6 differs from the method shown in FIG. 5 in that excitation pulses 13*c* and 14 are, additionally, formed in the control circuit 11 for the circuit breakers 7 and 8 (diagrams (a) and (b) of FIG. 6), wherein said excitation pulses 13*c* and 14 alternately occur in the HF resonant circuit with the frequency of the current signal 15 and each start with a zero passage A− or A+ of the current intensity and the maximum duration of which is somewhat longer than half the period of the oscillation of the current intensity 15 in the HF resonant circuit. An excitation pulse 13*c* for the circuit breaker 7 starting with the zero passage A+ is terminated with the next zero passage A−. If, however, the latter fails or cannot be detected for whatever reason, the excitation pulse 13*c* lasts until the falling edge 13*d* which is determined by the specified maximum duration of the excitation pulse 13*c* occurs. Where the shorter excitation pulses 13*c* that are terminated by a zero passage A+ or A− are concerned, the maximum possible duration of the excitation pulses 13*c* is shown in broken lines in FIG. 6.

An excitation pulse 14 for the circuit breaker 8 that starts with the zero passage A− is terminated by the occurrence of the next zero passage A+. If, however, the latter fails, the excitation pulse 14 is also prolonged in analogy to the excitation pulse 13*c* but no longer than to the specified point in time where the falling edge 14*d* occurs at the latest.

During normal trouble-free operation, the actual activation pulses 16 and 17 are generated by the current zero passages 1A−, A+ and A−, as described in FIGS. 3 to 5. In addition, the control circuit 11 checks whether a zero passage A+ or A− of the current intensity has been detected and signaled to the control circuit 11 for the duration of the excitation pulses 13*c* and 14, i.e., until the falling edge of the excitation pulses 13*c* and 14 has been reached. If this is not the case, the falling edge of the excitation pulse 13*c* and 14, respectively, that occurs at a specified later point in any event causes the switchover process between the circuit breakers 7 and 8, with the result that the HF resonant circuit is continued to be activated and the igniter 1 can fulfill its ignition task—although in a deteriorated manner. For this reason, a malfunction in the detection of the zero passage of the current intensity of the current signal 15 does not lead to a failure of the ignition but, rather, to a deterioration of the ignition. If, however, a zero passage A− or A+ of the current intensity 14 is detected for the duration of the excitation pulses 13*c* and 14, the excitation pulses 13*c* and 14 are shortened to half the period from A− to A+ and/or from A+ to A−.

The excitation pulses 13*c* and 14 can start at a zero passage of the current intensity 15 in the HF resonant circuit.

Figure 7:
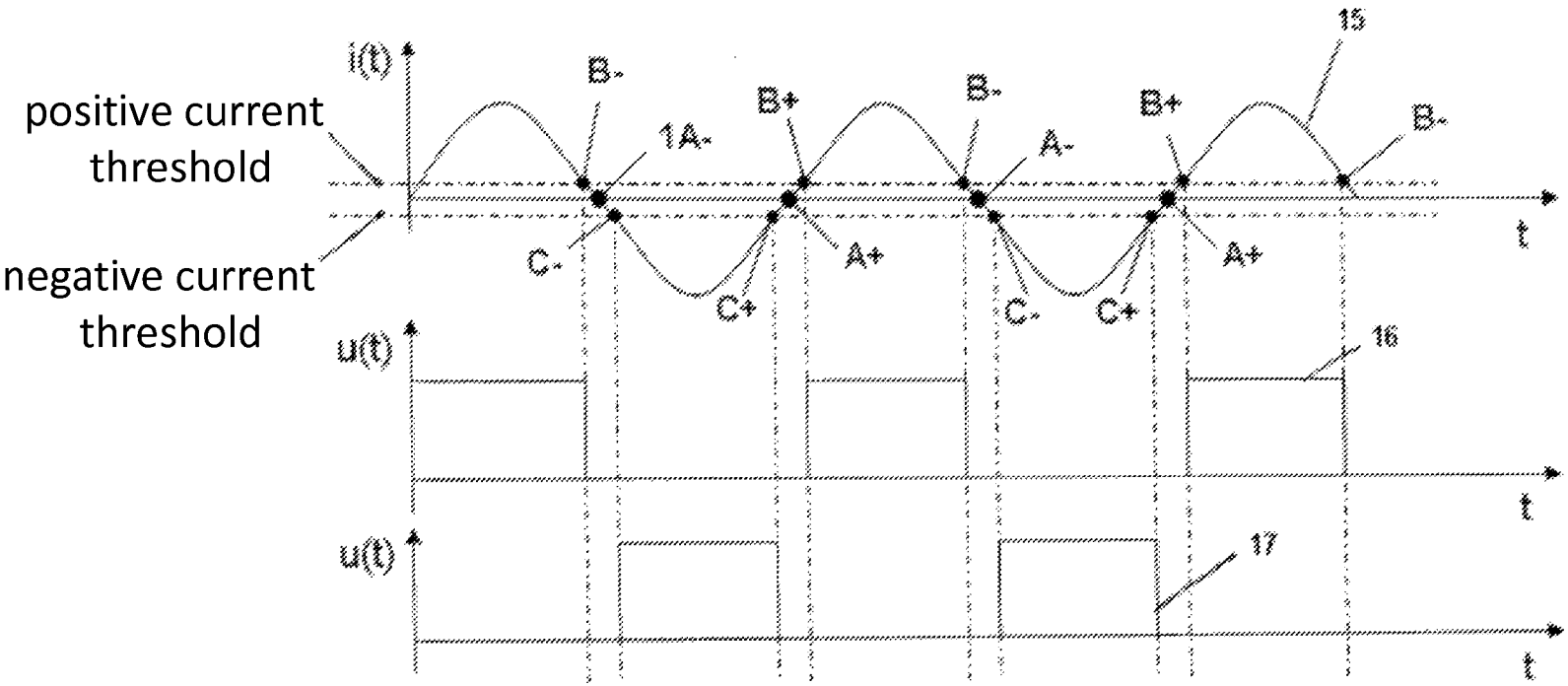
FIG. 7 is a diagram illustrating a fifth method according to the invention.

The zero passages of the current intensity signal 15 in the HF resonant circuit do not have to be determined exactly. It is also sufficient to provide a positive current threshold above the zero passages and a negative current threshold below the zero passages; see FIG. 7. Preferably, the current thresholds are close to the zero passages A− and A+. The intensity of the current signal 15 is then compared with the two current thresholds and, in the stead of the zero passages or in addition to the zero passages, the current passages B+ and B− are determined by the positive current threshold and the current passages C+ and C− are determined by the negative current threshold. The control pulse 16 for the circuit breaker 7 can then be limited by the successive current passages B+ and B− through the positive current threshold, whereas the control pulses 17 for the circuit breaker 8 are limited by the current passages C− and C+ through the negative current threshold, as shown in FIG. 7. In this case, the gaps shown in FIG. 7 are produced between the successive control pulses 16, 17, wherein this does not change the fact that the control pulses 16 as well as the current pulses 17 occur at a frequency which corresponds to the frequency of the current signal 15 in the HF resonant circuit, with the result that the desired excitation of the HF resonant circuit still has a high quality.

It is, however, also possible to combine the current passages through the positive and negative current thresholds with the zero passages of the current intensity in order to obtain control signals for the circuit breakers 7 and 8. One possibility is to deactivate the control pulse 16 at the time of the current passage B− and to reactivate it at the time of the current zero passage A+ and to deactivate it again at the time of the current passage C+. Another possibility is to deactivate the control pulse 16 at the time of the current zero passage A− and to reactivate it at the time of the current passage B+, whereas the control pulse 17 is activated at the time of the current passage C− and deactivated again at the time of the current zero passage A+.

Figure 8:
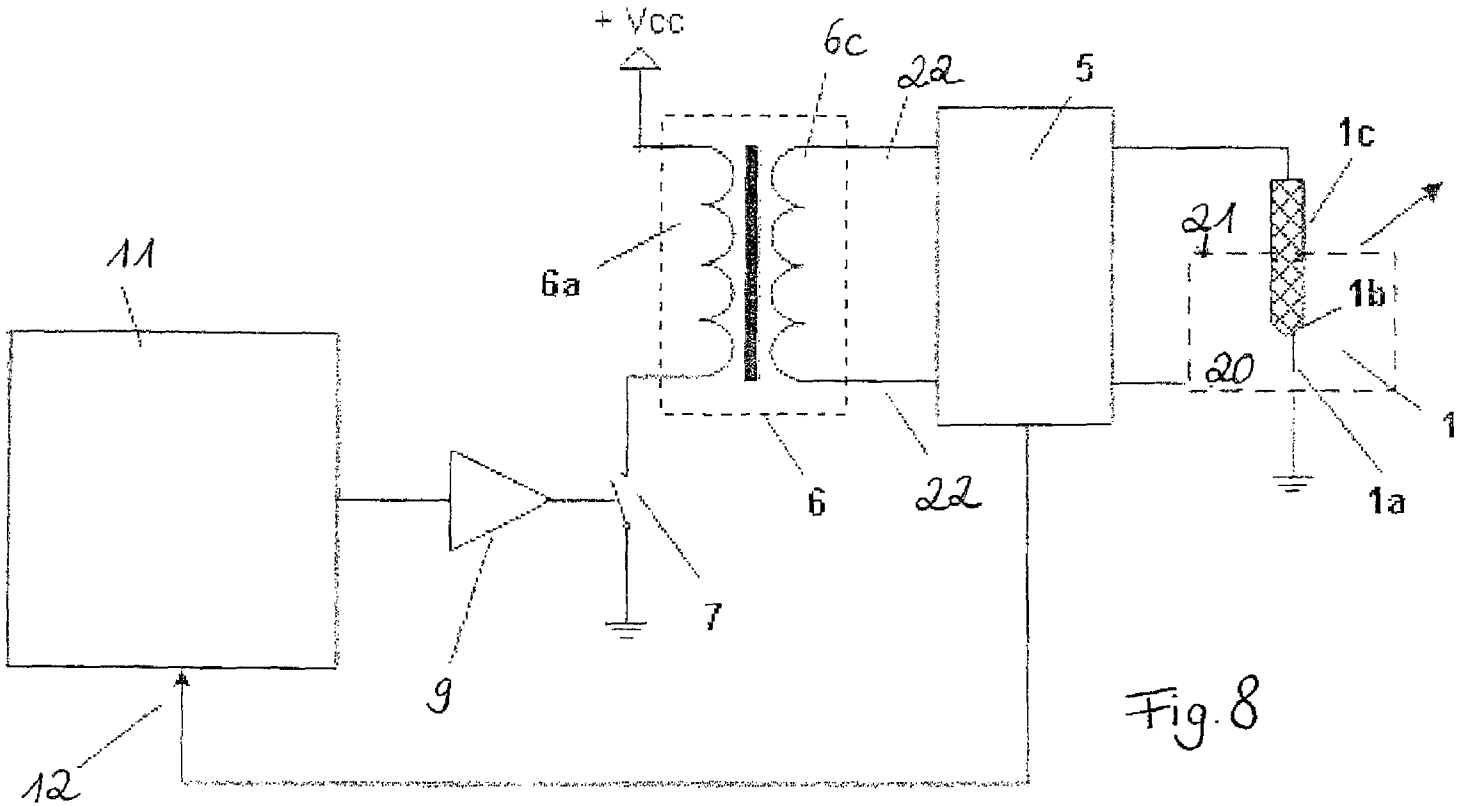
FIG. 8 is a schematic diagram showing the structure of a further HF ignition system for a vehicle engine.

FIG. 8 is a schematic diagram showing the structure of a further HF ignition system for a vehicle engine. In essence, this HF ignition system only differs from the systems shown in FIGS. 1 and 2 in that only pulses with one polarity can be fed into the primary side of the DC-AC inverter. This ignition system, therefore, has the advantage of a simplified structure. In particular, only a single switch 7 is required for activating the DC-AC inverter 6. As compared with the exemplary embodiments of FIGS. 1 and 2, a switch and an associated amplifier are, therefore, saved, with the result that both the expenditure in terms of material and that in terms of control are reduced.

Figure 9:
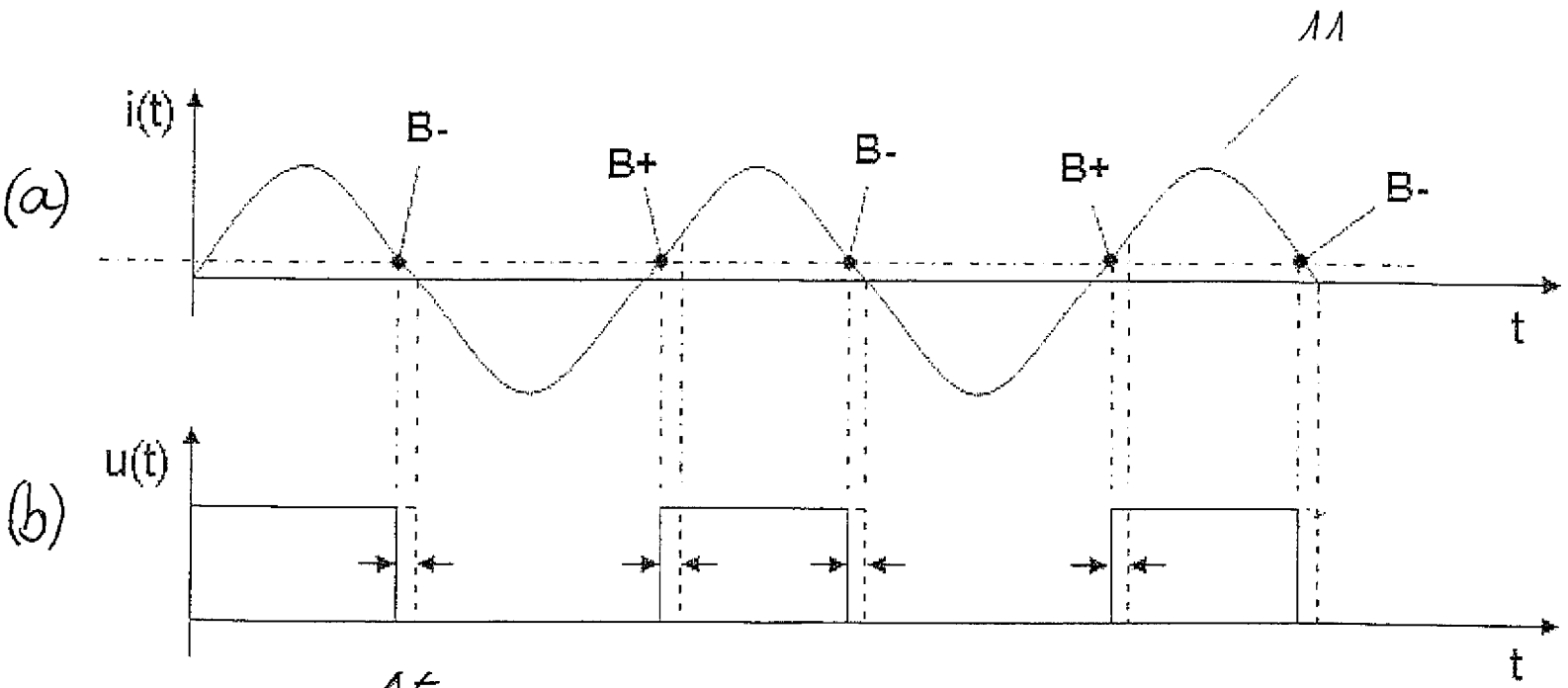
FIG. 9 is a diagram illustrating a sixth method according to the invention.

FIG. 9 is a schematic diagram illustrating a method for energizing the HF resonant circuit contained in the HF ignition system shown in FIG. 8. Schematic diagram (a) shows the behavior of the alternating current i excited in the HF resonant circuit in relation to the time t. Diagram (b) shows the pulses fed into the DC-AC inverter 6 for exciting this alternating current.

The control circuit 11 monitors the excited alternating current i(t) by means of two switching thresholds B− and B+. When the instantaneous value of the alternating current i(t) excited in the HF resonant circuit falls below the first switching threshold B−, the switch 8 is actuated and, therefore, a pulse fed into the DC-AC inverter 6 is terminated. When the instantaneous value of the alternating current i(t) exceeds the second switching threshold B+, the switch 7 is again actuated. This resets the switch 7 to its conducting state, with the result that a voltage or current pulse starts.

A switching time Δ t which is indicated in FIG. 9 elapses between the point when a switching process is triggered by falling below the switching threshold B− or exceeding the second switching threshold B+ and the point when the changed switching state of the switch 7 is reached. If the two switching thresholds B− and B+ correspond to each other, as it is the case in the exemplary embodiment of FIG. 9, the switching time Δ t can cause a shift of the transition between the switching states of the switch 7 closer to the zero passage of the alternating current or the alternating current voltage only at one switching threshold, which is the switching threshold B− in the exemplary embodiment shown. At the second switching threshold, which is the switching threshold B+ in the exemplary embodiment shown, however, the switching time Δ t causes the switch 7 not to change its switching state before the time lag reached after the zero passage has somewhat increased.

In order to keep switching losses as low as possible, it is desirable that the switch 7, which usually is a field effect transistor, changes its switching state in each zero passage or as close to the zero passage as possible.

Figure 10:
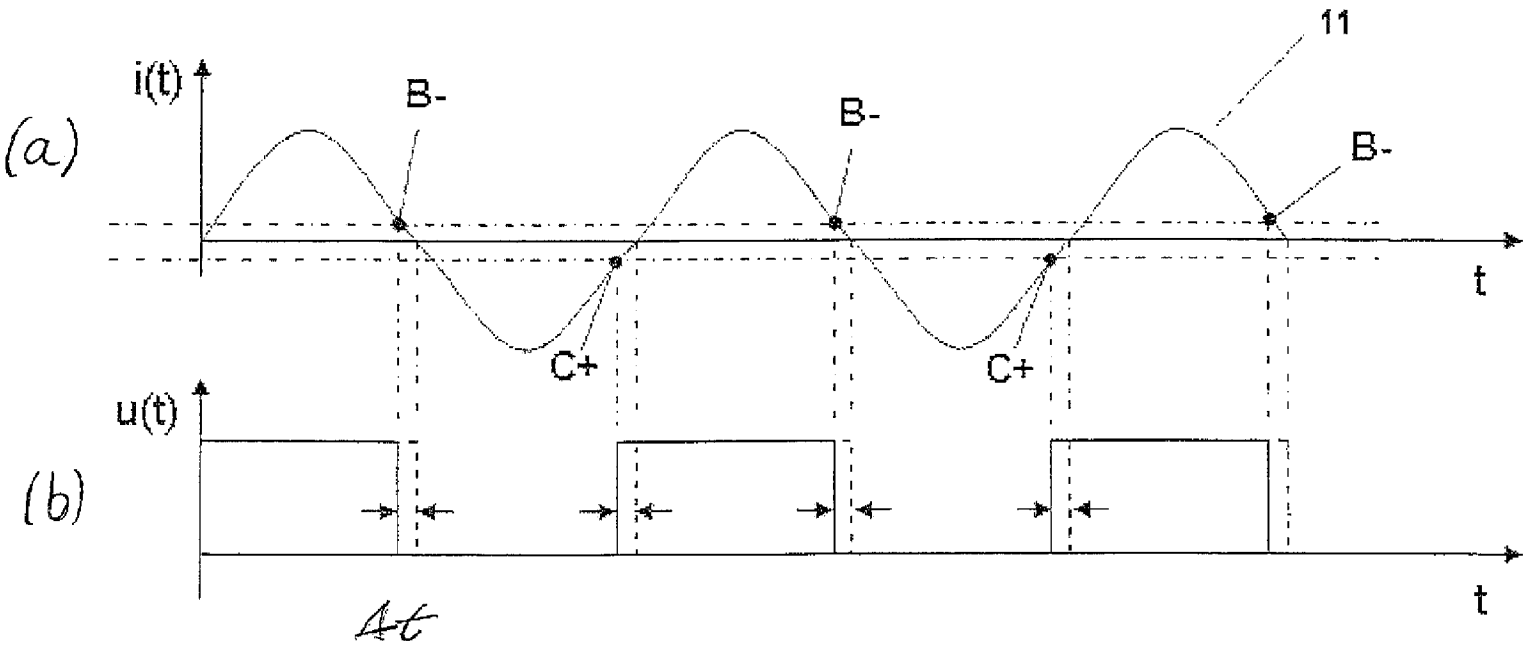
FIG. 10 is a diagram illustrating a seventh method according to the invention.

In order to achieve this, a second switching threshold C+ which is different from the first switching threshold B− can be used according to the exemplary embodiment shown in FIG. 10. The two switching thresholds B− and C+ have different signs and, preferably, the same amount. Switching losses can be minimized by the switching time Δ t of the switch 7 corresponding to the time that elapses between the point when the switching process is triggered, i.e., when a switching threshold is exceeded or fallen below, and a subsequent zero passage of the alternating current or the alternating current voltage.

REFERENCE SYMBOLS

1 HF igniter
1*a* Ignition electrode
1*b* Insulator
1*c* Outer conductor
2 Ohmic resistance
3 Inductance
4 Capacitance
5 Detector circuit
6 DC-AC inverter, transformer
6*a* Primary winding
6*b* Primary winding
6*c* Secondary winding
6*d* Center tap
7 Circuit breaker
8 Circuit breaker
9 Amplifier
10 Amplifier
11 Control circuit
12 Line
13*a* Excitation pulse
13*b* Excitation pulse
13*c* Excitation pulse
14 Excitation pulse
15 Current signal
16 Activation pulse
17 Activation pulse
18
19
20 Combustion chamber
21 Walls of 20
22 Interface

What is claimed is:

1. A method for energizing an HF resonant circuit, which contains an igniter as a component for igniting a fuel-air mixture in a combustion chamber of an internal combustion engine by means of a corona discharge, wherein the igniter comprises an ignition electrode and an insulator surrounding the ignition electrode, by means of a DC-AC inverter which is excited by successive current pulses that each last while a switch controlled by a control circuit is in its conducting state, the method comprising:

observing an instantaneous value of an alternating current or of an alternating current voltage in the HF resonant circuit;

actuating the switch when it is detected that the instantaneous value of the alternating current or the alternating current voltage excited in the HF resonant circuit falls below a first switching threshold and actuating the switch when it is detected that the instantaneous value of the alternating current or the alternating current voltage excited in the HF resonant circuit exceeds a second switching threshold.

2. The method according to claim 1, wherein the two switching thresholds of the switch have different signs.

3. The method according to claim 1, wherein the switch has a switching time which deviates from the time that elapses between the point when a switching operation is triggered and a subsequent zero passage of the alternating current or of the alternating current voltage by less than a factor of 2.

4. The method according to claim 1, wherein all current pulses have equal polarity.

5. The method according to claim 1, wherein successive current pulses have opposite polarity.

6. The method according to claim 1, wherein a series resonant circuit is used as HF resonant circuit.

7. The method according to claim 1, wherein a transformer is used as the DC-AC inverter and the current pulse is fed into a primary winding of the transformer.

8. The method according to claim 1, wherein the current pulses are formed as square-wave pulses.

9. The method according to claim 1, wherein the switch is actuated in its conducting state at the latest after a predefined duration has been completed which begins when the switch enters its conducting state and is longer than half the period of the HF resonant circuit, said period corresponding to a specified frequency at which the HF resonant circuit can oscillate.

10. The method according to claim 9, wherein the specified frequency has a defined value.

11. The method according to claim 9, wherein the specified frequency corresponds to the resonant frequency of the HF resonant circuit, which is the lowest possible one under the given basic conditions.

12. A method for energizing an HF resonant circuit, which contains an igniter as a component for igniting a fuel-air mixture in a combustion chamber of an internal combustion engine by means of a corona discharge, wherein the igniter comprises an ignition electrode and an insulator surrounding the ignition electrode, the method comprising:

providing a DC-AC inverter having at least one primary winding side and at least one secondary winding side, wherein the DC-AC inverter is configured to be excited on the primary winding side by successive current pulses that each last while a switch controlled by a control circuit is in its conducting state;

providing a detector circuit between the HF resonant circuit and the secondary winding side of the DC-AC inverter, the detector circuit configured to determine a falling below of a positive current threshold and a surpassing of a negative current threshold of a current intensity of a current signal in the HF resonant circuit;

detecting the falling below of the positive current threshold and the surpassing of the negative current threshold of the current intensity of the current signal in HF resonant circuit; and actuating the switch by the control circuit when the falling below of the positive current threshold or the surpassing of the negative current threshold is detected.

* * * * *